United States Patent [19]

Puchein

[11] 4,172,673

[45] Oct. 30, 1979

[54] WRITING INSTRUMENT USING THIN REFILL LEADS

[75] Inventor: Rudi Puchein, Triberg, Fed. Rep. of Germany

[73] Assignee: Gebr. Schmidt, Georgen, Fed. Rep. of Germany

[21] Appl. No.: 769,004

[22] Filed: Feb. 16, 1977

[30] Foreign Application Priority Data

Feb. 20, 1976 [DE] Fed. Rep. of Germany ..... 2606939

[51] Int. Cl.[2] ..... B43K 21/16

[52] U.S. Cl. ..... 401/65; 401/55; 401/67

[58] Field of Search ..... 401/55, 65, 67, 109, 401/110

[56] References Cited

U.S. PATENT DOCUMENTS

| | | | |
|---|---|---|---|
| 1,666,405 | 4/1928 | Caldwell et al. | 401/65 |
| 2,056,143 | 9/1936 | Robbins | 401/55 X |
| 2,340,665 | 2/1944 | Jacobs | 401/65 |
| 2,525,223 | 10/1950 | Lynn | 401/65 |

FOREIGN PATENT DOCUMENTS

| | | | |
|---|---|---|---|
| 480717 | 2/1938 | United Kingdom | 401/67 |

*Primary Examiner*—Edward M. Coven

*Attorney, Agent, or Firm*—Haseltine, Lake & Waters

[57] ABSTRACT

A writing instrument for thin lead refills comprising a housing and a lead feed mechanism located within the housing and wherein the feed of the lead refills is effected by a lead collet slidable axially against a spring force. The housing is sub-divided into front and rear housing sections which are axially adjacent one another and are relatively rotatable about a longitudinal axis of the instrument. To each housing section there is secured in rotation a component of a cam assembly comprising a thrust cam component and a thruster component. Upon relative rotation of the housing sections, the components interact with one another to slide the lead collet into projected open position for receiving a lead refill. One of the cam components is axially secured with the associated housing section and the other cam component is axially secured with the part of the lead feed mechanism carrying the lead collet and is axially displaceble with respect to the associated housing section.

31 Claims, 8 Drawing Figures

WRITING INSTRUMENT USING THIN REFILL LEADS

FIELD OF THE INVENTION

The invention relates to a writing instrument in the form of a mechanical pencil which uses thin refill leads, having a housing and a feed mechanism located within the housing, wherein the feed of the refill leads is effected by a lead collet slidable axially against a spring force.

BACKGROUND

For thin refill leads, pencils have been used wherein a mechanism for feeding and anchoring the leads in the writing position is actuated by a push-button projection out of the rear end of the housing. The actuation of a push-button is frequently found disagreeable and there exists a need to actuate the mechanism of the writing instrument in a simpler manner. It is consequently the aim of the invention to permit an actuation of the mechanism by relative rotation of mutually adjacent housing sections about the longitudinal axis of the housing.

SUMMARY OF THE INVENTION

According to the invention, in a writing instrument of the type described, the housing is sub-divided into front and a rear housing sections which are mutually adjacent axially, and the two housing sections are rotatable relative to each other about the longitudinal axis of the instrument, and one component of a cam gear comprising a thrust cam and thruster is attached integrally in rotation to each housing section, one component being axially connected firmly to the associated housing section and the other component being axially connected firmly to that part of the mechanism carrying the lead collet.

By a simple relative rotation of the two housing sections in mutually opposite directions, the mechanism can be actuated in a comfortable and simple manner and the lead is thereby fed into the writing position. A particular advantage of the writing instrument according to the invention lies in the fact that the housing need not include an aperture for the outward protrusion of a push-button. As an advantageous development of the invention, therefore, the housing is completely closed except for an aperture accommodating the writing tip. This is a considerable advantage not only from the technical production standpoint, but also as regards use, wear and dirt.

In a convenient further development of the invention, the mechanism is inserted into the front housing section, the thrust cam is formed on the open rear end of a tube connected integrally in rotation to that part of the mechanism carrying the lead collet, and the thruster is firmly attached to the rear housing section. In known manner, the part of the mechanism connected to the lead collet may be connected in axially fixed but rotatable manner to a lead chamber tube. In this case the tube conveniently also constitutes the lead chamber tube, which is in turn surrounded by an outer tube which is firmly connected to the stationary part of the mechanism, while the outer tube is provided with at least one longitudinal slit into which a tab projecting outwardly from the lead chamber tube protrudes. For a more equal loading, two mutually opposite longitudinal slits with two mutually opposite tabs may be provided. The tabs and longitudinal slits effect anchorage of the lead chamber tube in the direction of rotation, so that when the rear housing section is rotated with the thruster firmly inserted therein, the lead chamber tube is slid forwards and the mechanism is thus actuated.

In a further advantageous development of the invention, the outer tube is surrounded by a connecting tube which is mounted to be axially fixed but rotatable on the stationary part of the mechanism and is attached rigidly to the rear housing section, while the rear end of the front housing section is rotatably mounted on a section of the connecting tube. In this way the oppositely rotatable mounting of the housing section and simultaneously the cohesion of the two housing sections in the axial direction can be arranged in a simple manner.

In another advantageous embodiment of the invention, the mechanism is likewise inserted into the front housing section, but the thruster is axially in contact with the part of the mechanism carrying the lead collet, and at least one cam of the thruster is guided through at least one longitudinal slit of the stationary part of the mechanism which is not connected to the lead collet, and the thrust cam is constructed on a cam sleeve anchored in relation to the rear housing section. In this case the cam gear is conveniently likewise positioned in the front housing section, but in principle an arrangement of the cam gear in each part of the housing is possible. In a preferred embodiment, the cam sleeve surrounds the stationary part of the mechanism which contains the longitudinal slit or slits, through which a cam, or two cams, project into opposite sides, or the thruster connected to the lead collet outwardly protrudes. The cam sleeve need only be firmly connected in some manner to the rear housing section in order that the desired actuation of the mechanism occurs upon mutual rotation of the housing section. A lead chamber tube is normally attached to the mechanism. In this case, the cam sleeve is conveniently firmly connected to the lead chamber tube, and the lead chamber tube to the rear housing section.

In the retracted writing position of the mechanism, in which the lead collet is closed and firmly holds the lead, the thruster should preferably not be in contact with the thrust cam, since otherwise there is a danger of the lead collet opening slightly and the lead not being held sufficiently firmly. Due to this, however, a certain mutual rotation of the housing sections is possible without corresponding actuation of the mechanism, until in each case the thruster or its cam come into contact with the next portion of the thrust cam. In order to reduce this play of the two housing sections as far as possible, according to a further proposal of the invention a frictional brake device is provided which renders the mutual rotation of the two housing sections difficult.

In a further development, this brake device may be constituted by a resilient brake element in frictional contact with both the mutually rotating parts of the writing instrument. The brake element may be, for example, a resilient friction ring or a helicoidal spring part or a similar resilient member.

In a further embodiment, the friction ring or helicoidal spring part is in contact, on the one hand, with a collar of the stationary part of the mechanism and, on the other hand, with the cam sleeve. Clearly, it may also come into contact with any two other parts of the writing instrument which rotate in mutually opposite directions. This feature of the brake device has the further advantage that by this means the two housing sections are also drawn towards each other, so that no axial play occurs at their joint.

The thrust cam conveniently exhibits at least one minimum and at least one maximum, while each minimum corresponds to a retracted closed writing position of the lead collet, and each maximum corresponds to an advanced open position of the lead collet. Every mutually opposite rotation of the two housing sections therefore causes a feeding of the lead into the writing position. However, if the two housing sections are mutually rotated so far that the thruster comes into contact with a maximum of the thrust cam, then the lead collet is opened and the lead can be freely slid back into the housing. In principle, the form of the thrust cam may be chosen in any desired manner, so that either a rotation of the two housing sections in one direction, or any desired direction, results in actuation of the mechanism. For example, according to an advantageous embodiment, the thrust cam may extend through 360° and exhibit minima and maxima alternately. In this embodiment, when the housing sections are rotated in any desired direction the mechanism is actuated in every case. The cam pattern is conveniently symmetrical on both sides of each minimum and maximum, so that the lead feed is of equal magnitude in both directions of rotation.

However, in certain embodiments, stops limiting the mutual rotation of the housing sections may preferably be provided on the cam gear, so that the housing sections cannot be rotated beyond specific relative angular positions or, for example, only a mutual rotation in one direction is possible. In this case the thrust cam naturally need not be constructed symmetrically to the minima and maxima.

In order that the position of a maximum on the thrust cam can be adjusted more reliably, in an advantageous development a catch for the thruster is provided on each maximum of the thrust cam. As soon as the thruster, or a cam mounted on the thruster, has engaged this catch, which may consist, for example, of a slight depression on the thrust cam, the lead collet is opened and the lead can be slid back into the housing.

To enable the thrust forces to be better distributed, as a further development of the invention, the thrust cam may be constructed symmetrically to the longitudinal axis of the writing instrument and the thruster may exhibit two cams projecting towards opposite sides, which are in contact with mutually symmetrical parts of the thrust cam. With this embodiment, upon a relative rotation of the housing sections the thrust cam is therefore acted upon at diametrally opposite points each time.

Due to the division of the housing into two sections rotatable in opposite directions, the anchorage of the mechanism within the housing is somewhat difficult insofar as, for a specific mutual rotation of the housing sections, an equal feed of the lead refill should be ensured in each case. In order to solve this problem, as a further development of the invention it is proposed that the stationary part of the mechanism exhibits a tip part which is pressed into a writing tip of known form attached to the housing.

More particularly, the invention discloses a method of introducing the tip part into the writing tip, whereby first of all, the tip part is pressed up to approximately two thirds of its ultimate axial insertion depth into the bore of the writing tip provided therefore, and then the writing tip is screwed onto the stationary part of the mechanism as far as a stop. By this procedure it is ensured that the tip part of the mechanism is always inserted an equal distance into the writing tip, so that for all types of housings and other various constructions of the mechanism, a uniform feed of the lead always occurs because the clamp bushing which determines the lead feed is always stripped off the collet at a bore step of the tip part after an exactly determined travel.

BRIEF DESCRIPTION OF THE DRAWINGS

In order that the invention may be more fully understood, two embodiments in accordance therewith will now be described by way of example, with reference to the accompanying drawings, in which.

DETAILED DESCRIPTION

Figure 1:
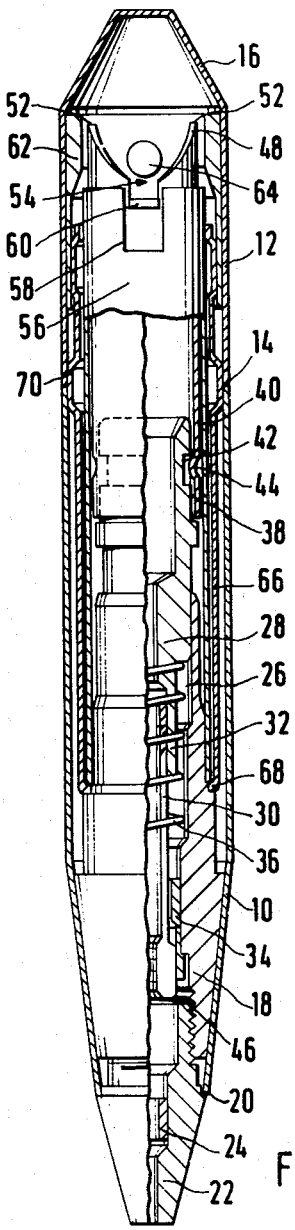
FIG. 1 is a longitudinal sectional view through a first embodiment of a writing instrument according to the invention, in which certain parts of the mechanism are shown broken away and in section.
Figure 2:
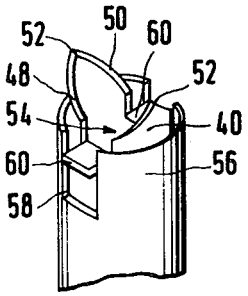
FIGS. 2 and 3 are isometric views of details at the rear end of the housing of the instrument illustrated in FIG. 1.
Figure 3:
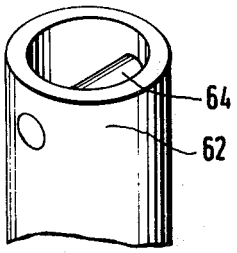

In the embodiment illustrated in FIGS. 1 to 3, a front housing section 10 and a rear housing section 12 are provided which are mutually adjacent axially along a joint line 14. The rear housing section 12 terminates in a closed cap 16 at the rear end.

The front housing section 10 receives a conventional mechanism, for example, as used in known push-button actuated pencils. This mechanism comprises a screw-threaded bushing 18 into which is screwed a writing point 22 braced against the front housing aperture 20. These two parts are thereby anchored to the front housing part 10. The writing point carries a lead brake 24 in customary manner.

A connector 28 is slidably inserted axially into a central bore 26 of the screw-threaded bushing 18. Due to close tolerances of the mutually adjacent cylindrical surfaces, the guidance of the connector in the axial direction is effected with high precision. Into the front end 32 of the connector 28 there is inserted a lead collet 30, the front end of which is surrounded in known manner by a clamp bushing 34. The clamp bushing 34 is itself guided axially with high precision in a bore of the screw-threaded bushing 18. The front end 32 of the connector 28 and a part of the lead collet 30 is further surrounded by a helicoidal compression spring 36, the rear end of which is braced against a shoulder of the connector 28, and the front end against a shoulder of the screw-threaded bushing 18. The spring 36 ensures the return of the connector 28 into the unactuated position of the mechanism each time it is released.

A lead chamber tube 40 is mounted firmly in the axial direction, but rotatably, on a rear projection 38 of the connector 28 by means of an indentation 44 engaging in an annular groove 42. With the exception of the two-part housing 10, 12 closed at the rear end, the components of the writing instrument hitherto described are of conventional construction. In the known push-button pencils, when the push-button is actuated, the connector 28 with the lead collet 30 is slid forwards and the lead, not shown, is thereby brought into the writing position. By striking against the shoulder 46 of the writing tip, the clamp bushing 34 is retained in an intermediate position and thereby releases the front end of the collet so that the collet is released from the lead. The lead is retained frictionally by the lead brake 24, while lead collet 30 and connector 28 move back into the initial position by the force of the compression spring 36. The lead collet is then closed again by means of the clamp bushing 34 and firmly retains the lead which now occupies the writing position.

In the mechanical pencil shown in the drawing, the open rear end of the lead chamber tube 40 is provided with two thrust cams 48 and 50 mutually symmetrical with respect to the longitudinal axis of the instrument. The two thrust cams merge at a maximum portion 52 on each side and each thrust cam 48 or 50 is, in turn, constructed symmetrically with respect to a minimum portion 54 located at its center and hollowed in the embodiment illustrated.

Connector 28 and lead chamber tube 40 are surrounded by an outer tube 56 whose front end is press fit onto the screw-threaded bushing 18. An open rear end of the outer tube 56 is formed with two longitudinal slits 58 located at mutually diametrically opposite positions, only one of which is fully visible in FIG. 1. A tab 60 projecting radially outwards from the lead chamber tube 40 protrudes into each longitudinal slit 58. Consequently, the lead chamber tube 40 is coupled to the front housing section 10 for rotation therewith but with sliding mobility in the axial direction conjointly with the connector 28 and with the lead collet 30.

A bushing 62 is pressed into the rear housing section 12. Transversely to the longitudinal axis of the bushing 62, a pin 64 is inserted rigidly which constitutes the thruster of a cam gear, the thrust cam of which is constituted by the thrust cams 48 and 50 constructed on the rear end of the lead chamber tube 40. To ensure that the lead collet 30 cannot open in the illustrated writing position of the mechanism, the thruster 64 does not rest upon the minimum portion 54 of the thrust cam, which in any case would be impossible in this embodiment owing to the concavity of the minimum portion. This results in a certain mutual rotatability of the two housing sections 10 and 12 before the thruster 64 comes into contact with the respective thrust cam 48 or 50 and causes a sliding of the lead chamber tube 40 forwards together with the slidable part 28, 30 of the mechanism. This rotation of the thruster 64, and hence the advance of the moving part of the mechanism, can be achieved by a simple rotation of the two housing parts 10 and 12 in mutually opposite directions. When the thruster 64 is located on the maximum portion 52 of the thrust cam, the lead collet 30 is opened and the lead refill can be slid back freely into the housing opposed only by the frictional force of the lead brake 24.

The rear end of a connecting tube 66 surrounding the outer tube 56 is secured rigidly but detachably to the bushing 62. At the front end of the connecting tube 66 there is an identation 68 which is held firmly in the axial direction by the front end of the outer tube 56. The front housing section 10 is mounted rotatably on a somewhat enlarged section 70 of the connecting tube 66 in contact with the inside of the housing sections 10, 12. The two housing sections are maintained in mutual contact axially, but with mutual rotatability, by the connecting tube 66.

Figure 4A:
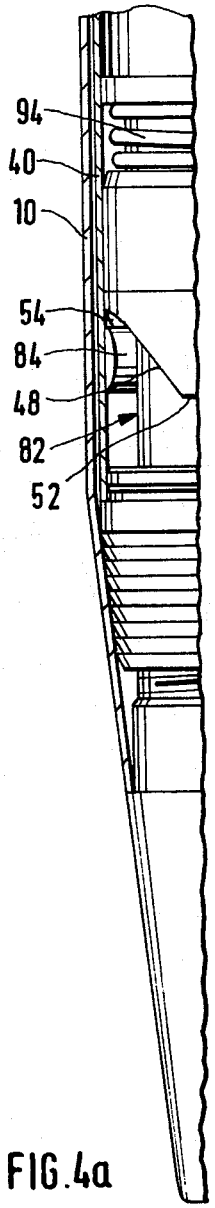
FIGS. 4*a* and 4*b* are longitudinal sections through the front part of a second embodiment of writing instrument according to the invention wherein certain parts of the mechanism are broken away and in section.
Figure 4B:
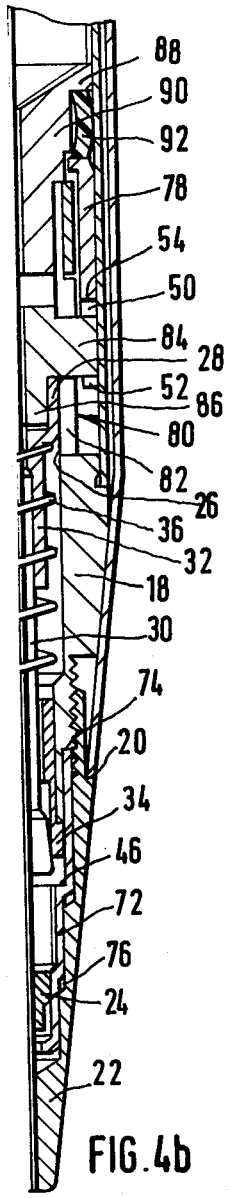
Figure 5:
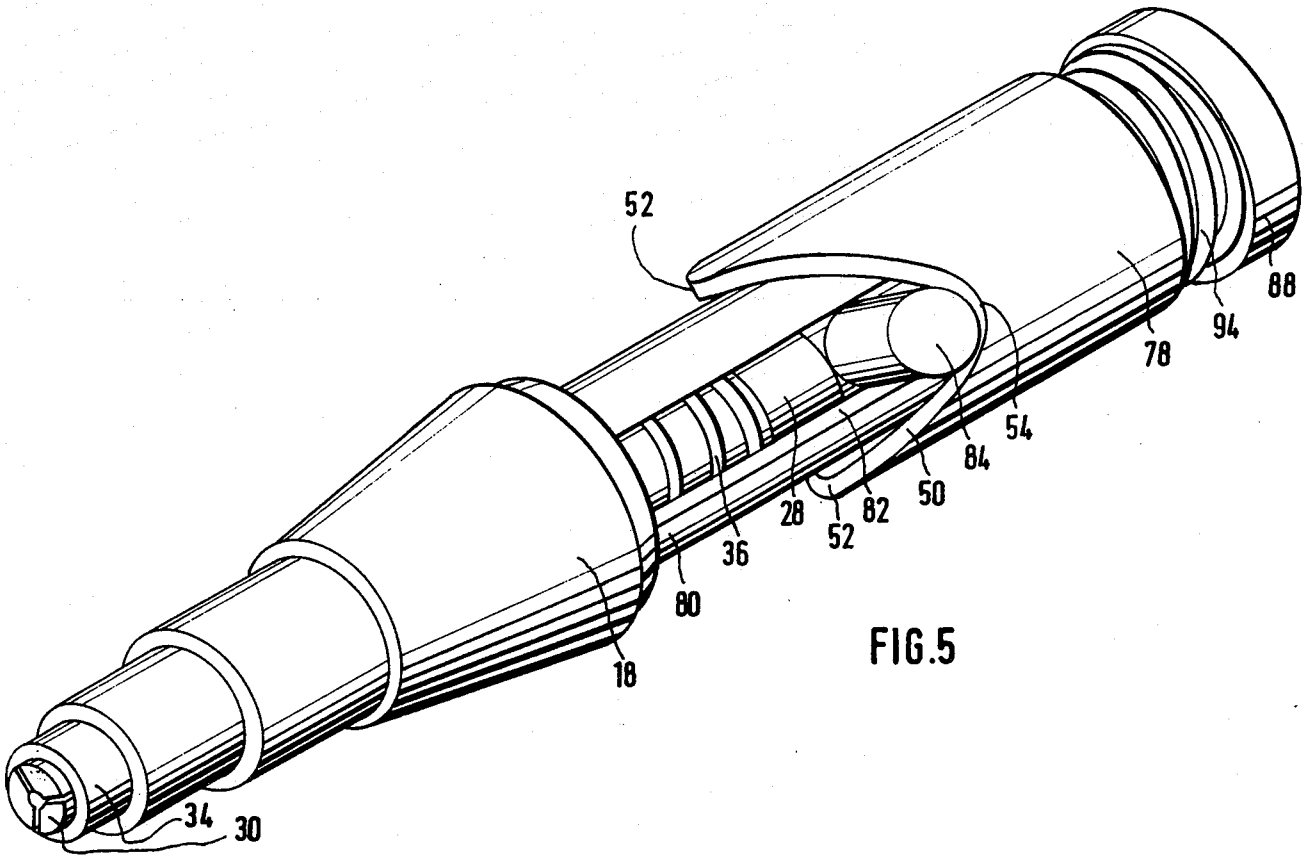
FIG. 5 is an isometric view of a part of the mechanism of the embodiment illustrated in FIG. 4.

In the embodiment illustrated in FIGS. 4 and 5, identical or corresponding parts are provided with the same reference numerals as in the embodiment first described. Because in this embodiment the parts according to the invention, insofar as they differ from parts of the first embodiment, are arranged in the front housing section 10, only the front housing section of the writing instrument is illustrated for the sake of simplicity. Again in this embodiment, the stationary part of the mechanism is constituted by a screw-threaded bushing 18 which is anchored by a writing tip 22 braced against the front aperture 20 of the housing section 10. The anchorage of the screw-threaded bushing 18 may however be effected by adhesives or by a press fit of the bushing into the front housing section 10.

In this embodiment, a particular tip part 72 of the mechanism is provided, the rear end of which is braced against a collar 74 of the screw-threaded bushing 18 and contains the lead brake 24. The external contour of the tip part 72 corresponds to a stepped interior bore 76 of the writing tip 22. The insertion of the tip part 72 into the writing tip 22 is preferably effected so that before the writing tip 22 is screwed onto the screw-threaded bushing 18, the tip part 72 is pressed into the writing tip 22 up to approximately two-thirds of its final axial insertion depth and the writing tip is then screwed on. Only by the screwing on does the tip part 72 attain its final axial position within the writing tip 22, because its rear end strikes against the collar 74 of the screw-threaded bushing 18. In this way a definite position of the tip part 72 is obtained which ensures a lead feed in every writing instrument independent of the depth to which the mechanism is pressed into the front housing section 10.

In this embodiment, the cam gear for the lead feed is likewise arranged in the front housing section 10. In this case, the thrust cam is constructed on a separate cam sleeve 78 which loosely surrounds a rear section 80 of the screw-threaded bushing 18. The cam sleeve 78 is pressed into the lead chamber tube 40 and the lead chamber tube 40 is in turn secured by its rear end, in a manner not shown, to the rear housing section 12. Again in this embodiment, two thrust cams 48 and 50 are provided symmetrical with respect to the longitudinal axis of the writing instrument, while each thrust cam exhibits a minimum portion 54, with respect to which it is arranged symmetrically, while a maximum portion 52 is arranged at each juncture between the two thrust cams 48 and 50.

The section 80 of the screw-threaded bushing 18 is provided with two diametrically opposite longitudinal slits 82, in which cams 84 of a thruster 86, projecting outwards to opposite sides, are slidably guided in the longitudinal direction.

When the rear housing section 12, not shown, is rotated with reference to the front housing section 10, the symmetrical thrust cams 48 and 50 come into contact with the cams 84 of the thruster 86 and slide the latter, conjointly with the connector 28 and with the lead collet 30, forwards against the force of the compression spring 36. Because the two thrust cams are also constructed symmetrically to both sides with respect to the minimum portions 54, a lead feed occurs during each mutual rotation of the housing sections 10 and 12 in any direction. As soon as the cams 84 arrive in the region of the maximum portions 52 of the thrust cams, the lead collet 30 opens and the lead is released.

As will be seen from FIG. 4, two cams 84 in the retracted writing position of the mechanism illustrated are not in contact with the associated minimum portion 54 of the thrust cam. Consequently, a slight mutual rotatability of the housing sections 10 and 12 is possible without actuating the mechanism, until the cams 84 come into contact with the thrust cam. In order to render this mutual rotatability difficult, a resilient friction ring 92 made of soft plastic or the like, or a helicoidal spring part 94, is inserted between the rear end of the cam sleeve 78 and a collar 88 of a bushing 90 pressed into the rear section 80 of the screw-threaded bushing 18. The friction ring 92 or the helicoidal spring part 94 is, in each case, in frictional contact with the cam sleeve 78 and with the collar 88. In FIG. 4, the section of a friction ring 92 is illustrated on the right side, and a helicoidal spring part 94 in side elevation as an alternative on the left side. The helicoidal spring part 94 is shown in FIG. 5. The friction element 92 or 94 renders difficult the rotation between the parts of the mechanism connected integrally in rotation to the two housing sections 10 and 12. Furthermore, since the cam sleeve 78 is connected rigidly to the lead chamber tube 40, the elastic friction element 92 or 94 draws the rear housing section 12, through the lead chamber tube 40, towards the writing tip, so that any axial play between the two housing sections is avoided.

With reference to FIG. 5 it should also be mentioned here that while the screw-threaded bushing 18 is of conventional type, it is of slightly different construction for the embodiment shown in FIG. 4, which is otherwise identical. Howver, this is irrelevant to the present invention with the exception of the rear section 80 and its construction, already explained.

Figure 6:
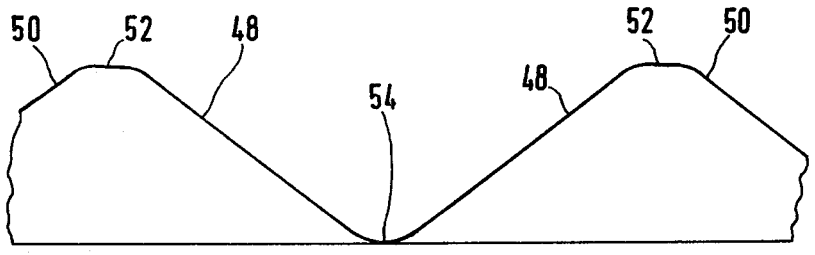
FIGS. 6 and 7 shown partial planar developments of thrust cams which are suitable for use in the embodiment shown in FIGS. 4 and 5, and also, if appropriately adapted, for the embodiment shown in FIG. 1.
Figure 7:
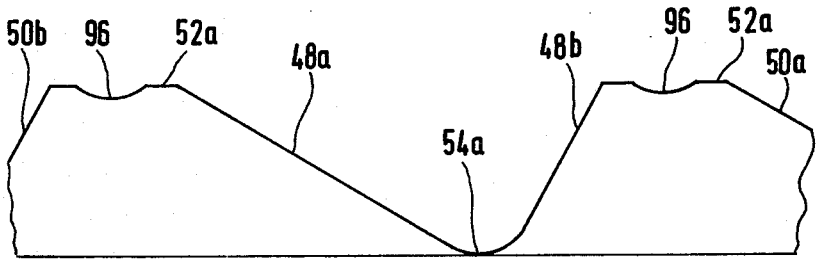

FIGS. 6 and 7 are partial planar developments of thrust cams which can be used advantageously in the cam gear of the instrument according to the invention. The development according to FIG. 6 corresponds somewhat to the thrust cam 48, 50 which is employed in the cam sleeve according to FIGS. 4 and 5. Each thrust cam 48 or 50 is arranged symmetrically on both sides of the associated minimum portion 54. Moreover, although this is not apparent from the development, the two thrust cams 48 and 50 are arranged axially symmetrically with respect to the longitudinal axis of the writing instrument, so they are always followed uniformly by the two cams 84 of the thruster 86.

A somewhat different embodiment of the thrust cam is illustrated in FIG. 7, likewise in a partial planar development. Here also, minimum portions **54*a* and maximum portions 52*a* are provided. But in order to facilitate the finding of the respective maximum during mutual rotation of the two housing sections 10 and 12, a catch or detent 96 is provided in the region of each maximum portion 52*a* in the form of a slight indentation or recess in the maximum portion. The catches 96 serve to accommodate the respective cam 84** in the open position of the mechanism, in which the lead refill can be slid back into the housing.

The thrust cam in this embodiment, exhibits in each case, two flat flanks **48*a* facilitating the mutual rotation of the housing sections, and two very steep flanks 48*b* preventing any mutual rotation of the housing sections in the opposite direction. The angular range available for the mutual rotation of the housing sections is therefore distributed for the greater part, to the flat flanks 48*a*, and, to a very small part, to the flanks 48*b*. Accordingly, in this embodiment only a mutual rotation of the housing sections in a single direction is possible to order to actuate the mechanism. Because, here again, the two thrust cams 48*a*, 48*b* and 50*a*, 50*b* are arranged axially symmetrically with respect to the longitudinal axis of the instrument, they are likewise followed uniformly by the two cams 84**.

What is claimed is:

1. In a writing instrument for a thin lead refill comprising a housing and a lead feed mechanism located within the housing, wherein the feed of the lead refill is effected by a lead collet slidable axially against a spring force, the improvement wherein the housing is subdivided into front and rear housing sections which are axially adjacent one another and relatively rotatable about a longitudinal axis of the instrument, a cam gear means comprising a thrust cam component and a thruster component for sliding the lead collet upon relative rotation of said housing sections, each housing section being integrally connected in rotation with a respective component of said cam gear means, one said component being firmly connected axially with the associated housing section, means coupling the other component for axial movement with the lead collet relative to the associated housing section, said lead feed mechanism being located within the front housing section and including a movable part carrying the lead collet and a stationary part not connected to the lead collet, said thruster component being in contact axially with the movable part of the mechanism carrying the lead collet, said thruster component including at least one cam guided in at least one longitudinal slit provided in the stationary part of the mechanism which is not connected to the lead collet, and a cam sleeve surrounding the stationary part of the lead feed mechanism and anchored with respect to the rear housing section, said thrust cam component being on said cam sleeve, said coupling means comprising a lead chamber tube connected to the rear housing section, said cam sleeve being firmly connected to said lead chamber tube, and brake means for frictionally opposing relative rotation of the housing sections.

2. A writing instrument according to claim 1, wherein the housing is completely closed except for the provision of an aperture accommodating a writing tip.

3. A writing instrument according to claim 1, wherein said brake means comprises a resilient brake element in frictional contact with two mutually rotating parts of the writing instrument.

4. A writing instrument according to claim 3, wherein said brake element is constituted by a resilient friction ring.

5. A writing instrument according to claim 4, wherein said brake element is constituted by a helicoidal spring.

6. A writing instrument according to claim 1, wherein said brake means is on contact, on the one hand with the stationary part of the mechanism and, on the other hand, with the cam sleeve.

7. A writing instrument according to claim 1, wherein said thrust cam component has at least one minimum portion, and at least one maximum portion, each minimum portion corresponding to a retracted closed writing position of the lead collet and each maximum protion corresponding to an advanced open position of the lead collet.

8. A writing instrument according to claim 7, wherein said thrust cam component extends through 360° and has alternate minimum and maximum portions.

9. A writing instrument according to claim 7, wherein said thrust cam component is symmetrical on both sides of each minimum and maximum portion.

10. A writing instrument according to claim 7, comprising stops on said cam gear means for limiting the relative rotation of the housing sections.

11. A writing instrument according to claim 7 comprising detent means for the thruster component on each maximum portion of the thrust cam component.

12. A writing instrument according to claim 7, wherein said thruster component is spaced from the thrust cam component in the position facing the minimum portion of the thrust cam component.

13. A writing instrument according to claim 7, wherein said thrust cam component is symmetrical with respect to the longitudinal axis of the writing instrument and said thruster component includes two parts projecting in opposite directions in contact with mutually symmetrical points of the thrust cam component.

14. A writing instrument according to claim 1, wherein the mechanism includes a stationary part with a tip part which is pressed into a writing tip.

15. A writing instrument according to claim 1 wherein said thrust cam component comprises minimum and maximum portions and angularly inclined portions joining said maximum and minimum portions; said angularly inclined portions being symmetrical so that the lead collet will undergo sliding when the housing sections are relatively rotated in both directions.

16. A writing instrument according to claim 15, comprising stops on said cam gear means for limiting the relative rotation of the housing sections.

17. A writing instrument according to claim 1 wherein said cam sleeve has greater thickness than said lead chamber tube.

18. A writing instrument according to claim 1, wherein said lead feed mechanism is a self-contained unit which is insertable into said housing, said instrument further comprising a writing tip threadably engaged within said housing, said lead feed mechanism including a stepped tip part engaged in a stepped bore provided in said writing tip.

19. A writing instrument according to claim 18, comprising a bushing threaded in said front housing at the front thereof, said writing tip being threadably engaged on said bushing.

20. A writing instrument according to claim 1, said brake means comprising a ring element frictionally opposing relative rotation of the cam sleeve and said movable part carrying the lead collet.

21. In a writing instrument for a thin lead refill comprising a housing and a lead feed mechanism located within the housing, wherein the feed of the lead refill is effected by a lead collet slidable axially against a spring force, the improvement wherein the housing is subdivided into front and rear housing sections which are axially adjacent one another and relatively rotatable about a longitudinal axis of the instrument, a cam gear means comprising a thrust cam component and a thruster component for sliding the lead collet upon relative rotation of said housing sections, each housing section being integrally connected in rotation with a respective component of said cam gear means, one said component being firmly connected axially with the associated housing section, means coupling the other component for axial movement with the lead collet relative to the associated housing section, said thrust cam component having at least one minimum portion and at least one maximum portion, said minimum portion corresponding to a retracted closed writing position of the lead collet and said maximum portion corresponding to an advanced open position of the lead collet, and stops on said cam gear means for limiting the relative rotation of the housing section.

22. A writing instrument according to claim 2, wherein said thrust cam component extends through 360° and has alternate minimum and maximum portions.

23. A writing instrument according to claim 2, wherein said thrust cam component is symmetrical on both sides of each minimum and maximum portion.

24. A writing instrument according to claim 2 comprising detent means for the thruster component on each maximum portion of the thrust cam component.

25. A writing instrument according to claim 2, wherein said thruster component is spaced from the thrust cam component in the position facing the minimum portion of the thrust cam component.

26. A writing instrument according to claim 2, wherein said thrust cam component is symmetrical with respect to the longitudinal axis of the writing instrument and said thruster component includes two parts projecting in opposite directions in contact with mutually symmetrical points of the thrust cam component.

27. In a writing instrument for a thin lead refill comprising a housing and a lead feed mechanism located within the housing, wherein the feed of the lead refill is effected by a lead collet slidable axially against a spring force, the improvement wherein the housing is subdivided into front and rear housing sections which are axially adjacent one another and relatively rotatable about a longitudinal axis of the instrument, a cam gear means comprising a thrust cam component and a thruster component for sliding the lead collet upon relative rotation of said housing sections, each housing section being integrally connected in rotation with a respective component of said cam gear means, one said component being firmly connected axially with the associated housing section, coupling means coupling the other component for axial movement with the lead collet relative to the associated housing section and brake means for frictionally opposing relative rotation of the housing sections, said lead feed mechanism being located within the front housing section, said coupling means comprising a tube connected integrally in axial movement with the lead collet and having an open rear end, the thrust cam component being mounted at said open rear end, said tube constituting a lead chamber tube, the lead feed mechanism comprising a portion connected to the lead collet and connected axially firmly but with rotary mobility to said lead chamber tube, said lead feed mechanism including a stationary part, and an outer tube surrounding said lead chamber tube, said outer tube being connected firmly to the stationary part of the lead feed mechanism, said outer tube being provided with at least one longitudinal slit, said lead chamber tube including a tab projecting outwards into said slit.

28. A writing instrument according to claim 27, comprising a connecting tube surrounding said outer tube and mounted axially firmly but with rotary mobility on the stationary part of the lead feed mechanism and which is fastened rigidly to the rear housing section, said front housing section including a rear end rotatably mounted on said connecting tube.

29. A writing instrument according to claim 27 wherein said lead feed mechanism comprises a stationary part including a tip part, and a writing tip secured in said front housing section, said tip part being insertably fitted in said writing tip.

30. A writing instrument according to claim 27 wherein said thruster component is firmly connected to said rear housing section.

31. In a writing instrument for a thin lead refill comprising a housing and a lead feed mechanism located within the housing, wherein the feed of the lead refill is effected by a lead collet slidable axially against a spring force, the improvement wherein the housing is subdivided into front and rear housing sections which are axially adjacent one another and relatively rotatable about a longitudinal axis of the instrument, a cam gear means comprising a thrust cam component and a thruster component for sliding the lead collet upon relative rotation of said housing sections, each housing section being integrally connected in rotation with a respective component of said cam gear means, one said component being firmly connected axially with the associated housing section, means coupling the other component for axial movement with the lead collet relative to the associated housing section, said lead feed mechanism being located within the front housing section, the coupling means comprising a lead chamber tube connected integrally in axial movement with the lead collet and having an open rear end, the thrust cam component being mounted at said open rear end, said thruster component being firmly connected to said rear housing section, said lead feed mechanism comprising a portion connected to the lead collet and connected axially firmly but with rotary mobility to said lead chamber tube, said lead feed mechanism including a stationary part, and an outer tube surrounding said lead chamber tube, said outer tube being connected firmly to the stationary part of the lead feed mechanism, said outer tube being provided with at least one longitudinal slit, said lead chamber tube including a tab projecting outwards into said slit and a connecting tube surrounding said outer tube and mounted axially firmly but with rotary mobility on the stationary part of the lead feed mechanism and which is fastened rigidly to the rear housing section, said front housing section including a rear end rotatably mounted on said connecting tube.

* * * * *